US007217434B1

(12) United States Patent
Loh et al.

(10) Patent No.: US 7,217,434 B1
(45) Date of Patent: May 15, 2007

(54) CONDIMENT DISPENSER FOR BEVERAGE CONTAINER

(76) Inventors: Bill Loh, 58 Goodman Road, Singapore (SG); Robert S. Smith, 1263 Emory St., San Jose, CA (US) 95126

( * ) Notice: Subject to any disclaimer, the term of this patent is extended or adjusted under 35 U.S.C. 154(b) by 11 days.

(21) Appl. No.: 10/998,279

(22) Filed: Nov. 23, 2004

(51) Int. Cl.
*B65D 6/00* (2006.01)
*B65D 21/02* (2006.01)

(52) U.S. Cl. ..... 426/115; 426/120; 426/124; 206/217; 206/541

(58) Field of Classification Search ..... 426/120, 426/115, 112, 85, 86, 124; 206/217, 541, 206/514, 223; 220/709, 705, 521
See application file for complete search history.

(56) References Cited

U.S. PATENT DOCUMENTS 4,054,205 A * 10/1977 Blow et al. ..... 206/217
4,074,827 A * 2/1978 Labe, III ..... 220/522
5,176,283 A * 1/1993 Patterson et al. ..... 220/574
5,180,079 A * 1/1993 Jeng ..... 220/705
6,338,417 B1 * 1/2002 Ferraro ..... 220/23.83
6,706,297 B1 * 3/2004 Toth et al. ..... 426/120
2004/0262323 A1 * 12/2004 Cha ..... 220/709

* cited by examiner

*Primary Examiner*—Reginald L. Alexander
(74) *Attorney, Agent, or Firm*—Robert Samuel Smith

(57) ABSTRACT

A container for condiments, e.g., nuts and nuggets of chocolates, comprising a cylinder with a bottom side mountable on the top of a standard cup/can. In one version, a bottom side is displaced from the bottom edge of the cylinder to form a skirt on the bottom edge of the cylinder. The skirt has an interior lip dimensioned such that the container "snaps" onto the rim of a beverage can or cup. In another version, the cylinder and cup/can are telescoped into a sleeve. The top edge of cap/cup is adhered to a cover that is peeled back for access to the condiments. In another version, a partial lid is interposed between the cover and top rim of the cylinder. A drinking straw is inserted from the above the cover, through the container into the cup/can.

8 Claims, 3 Drawing Sheets

CONDIMENT DISPENSER FOR BEVERAGE CONTAINER

FIELD OF THE INVENTION

This invention relates to condiment packages and particularly to a package that engages the top of a beverage container.

BACKGROUND AND INFORMATION DISCLOSURE

Beer and nuts have long been associated with one another like doughnuts and coffee, peanut butter and jelly, bacon and eggs. However, a unique problem exists with dispensing beer and nuts in that beer and nuts are often eaten when the eater is "on the move" such as through a crowd, shaking hands at a party.

Another scenario is where the eater is in the company of a number of people, such as at a bar or around a pool. Nuts are not "ladled out" to individuals like mash potatoes or slices of beef. The nuts are placed in an open dish and the eater is invited to 'grab a handful". Oftentimes the eater's hand is not quite big enough to grab as many nuts as he would like to satisfy his appetite. Then the dispensing of nuts becomes a "polite" contest as to where the dish containing the nuts will finally reside.

Another problem with the "open dish" method of dispensing nuts is that, in the minds of many, the practice of many hands dipping into a common container can result in spreading bacteria.

SUMMARY OF THE INVENTION

It is an object of this invention to provide a combination dispenser of nuts and beverage that enables the user to hold the combination dispenser in one hand while eating/drinking, leaving the other hand free to answer a cell phone or shaking a hand or operating a steering wheel.

It is another object that the dispenser includes a "serving size package" of nuts.

It is another object that the dispenser be sealed so that the nuts are protected from contamination until the time when the user is ready to eat the nuts.

It is another object that the dispenser of nuts be configured to engage a can of beverage wherein the can is a "standard" can so that the dispenser of nuts can be displayed and sold as an item separate from the can of beverage.

This invention is directed toward a package of nuts that is engaged with the top of a beverage container.

In one embodiment, the beverage container is a standard can known to the public as one of a "six Pack."

The package of nuts includes a cylindrical section having a closed bottom and a lid that seals the open top of the cylindrical section until the user desires access to the nuts.

In one embodiment, the lid comprises two laminates. The first laminate covers the entire open end of the cylinder. The second laminate covers part of the first laminate and extends around and is sealed to about three quarters of the rim of the cylinder.

In use, the user tears off the first laminate so that the top of the cylinder is partly covered leaving an opening to access nuts that are stored inside the cylinder. The user eats these nuts by pouring them into his mouth or he pours them into his open hand.

Tearing off the first laminate also uncovers a small (straw-size) hole in the second laminate uncovering a channel formed in the side of cylinder through which the user can insert a straw extending down to the beverage stored in the can/cup.

In another embodiment, the bottom in the lower end of the cylinder is displaced from the lower edge of the channel. The lower edge of the cylinder is a skirt. The skirt is dimensioned to fit snugly around the top of the can.

DESCRIPTION OF A BEST MODE

Figure 1:
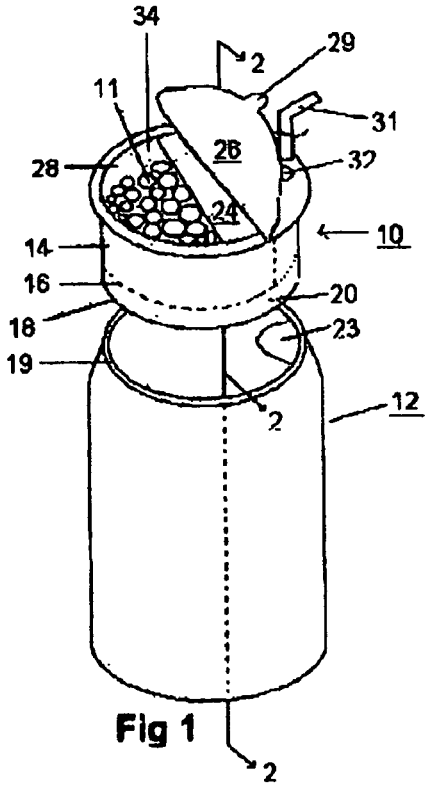
FIG. 1 is an assembly view of the container poised for attachment to the can.

Turning now to a description of the drawings, FIGS. 1-5 show versions of the invention being a container 10 for nuts 11 configured for mounting on the top end 19 of a standard beverage cup or can 12.

The standard beverage can/cup 12, presently on the market has an outside ridge 19 around the upper edge of the cup/can 12.

In each version, the container 10 comprises an integrally formed (molded) cylinder 14 and may have a partial lid 24 that extends over about two thirds of the container 10 opening.

FIG. 1 shows one version of the container in which a bottom side 16 (in phantom) is displaced from the lower edge 18 of the cylinder 14 so that a short skirt 20 is formed which includes the lower edge 18.

Figure 2A:
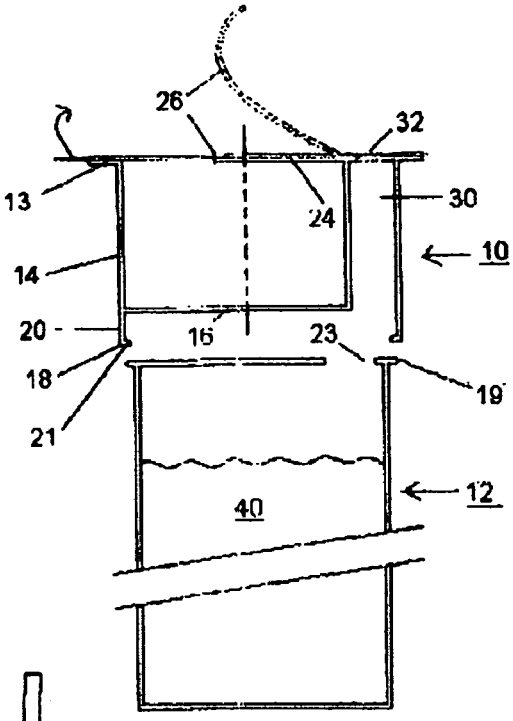
FIG. 2A is a sectional view of FIG. 1.

FIG. 2A is a sectional view of FIG. 1.

Figure 2B:
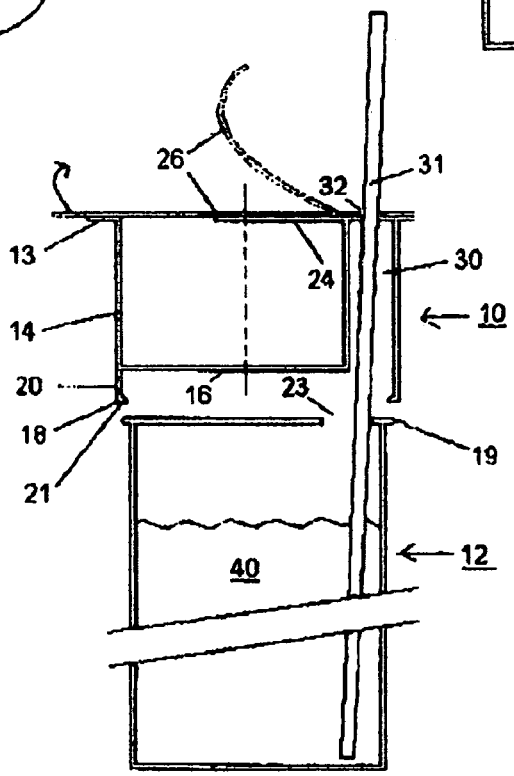
FIG. 2B is the same as 2A but also showing a drinking straw positioned inside the cylinder and can.

FIG. 2B is the same as FIG. 2A but shows a drinking straw 31 extending down through the cylinder 14 into the beverage 40.

The lower edge 18 of skirt 20 has an inside lip 21 dimensioned so that the lip 21 "snaps" onto the ridge 19 around the top edge of the cup/can 12.

Figure 3A:
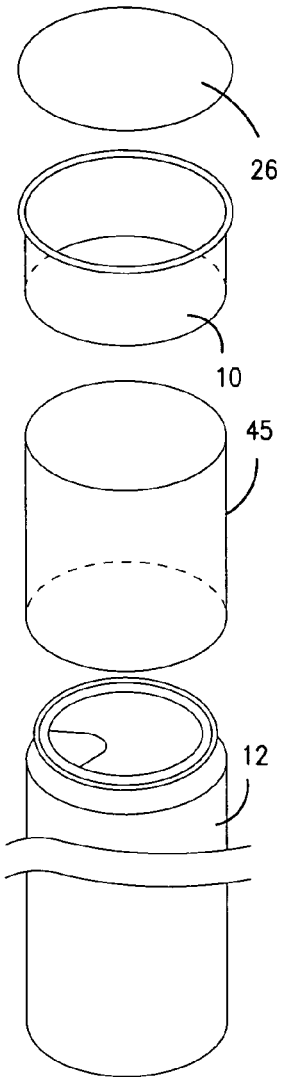
FIGS. 3A, B, C are views of the container joined to the cup/can where the means of joining is a sleeve.

FIG. 3A is an exploded view of another version for mounting the container 10 on the can 12 in which the means for mounting the container 10 on the can/cup 12 is a sleeve 40.

Figure 3B:
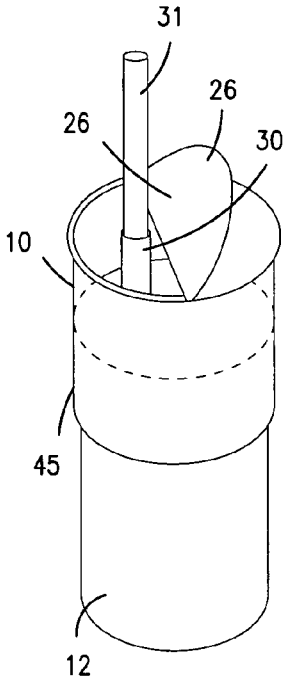

FIG. 3B is an assembly view showing the can 12 inserted into one end of sleeve 40 and the container 10 inserted into the opposite end of sleeve 40.

Figure 3C:
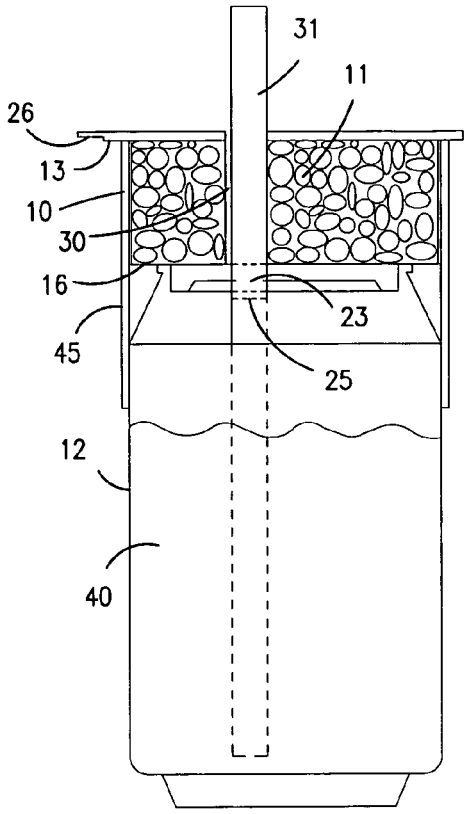

FIG. 3C is a sectional view of FIG. 3B showing nuts in the container 10 and drinking straw 31 extending through the container 10 into the beverage 40.

Figure 4:
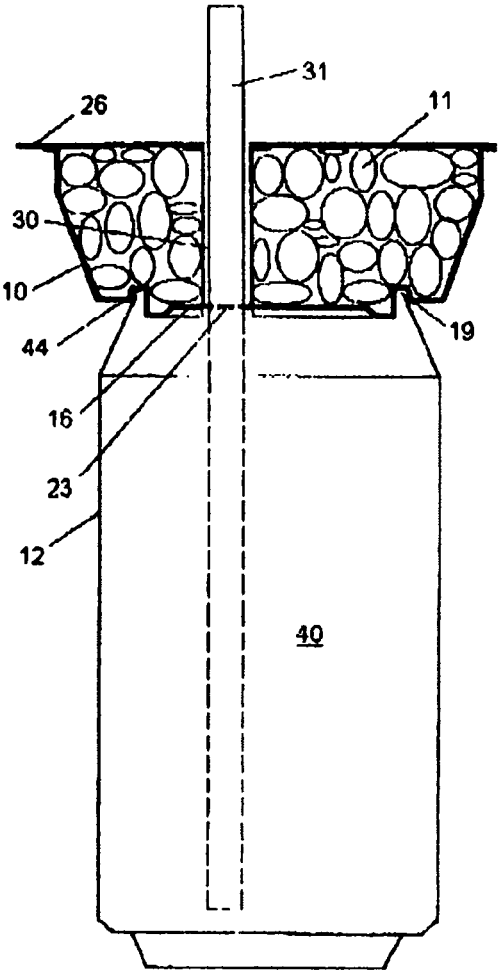
FIG. 4 shows the container having grooved bottom for engaging the cup/can.

FIG. 4 is a side view of a third version for mounting the container 10 on the can 12 in which the container 10 has a bottom side 42 with a molded groove 44 that mates with the ridge 19 on the top edge of can 12.

Figure 5:
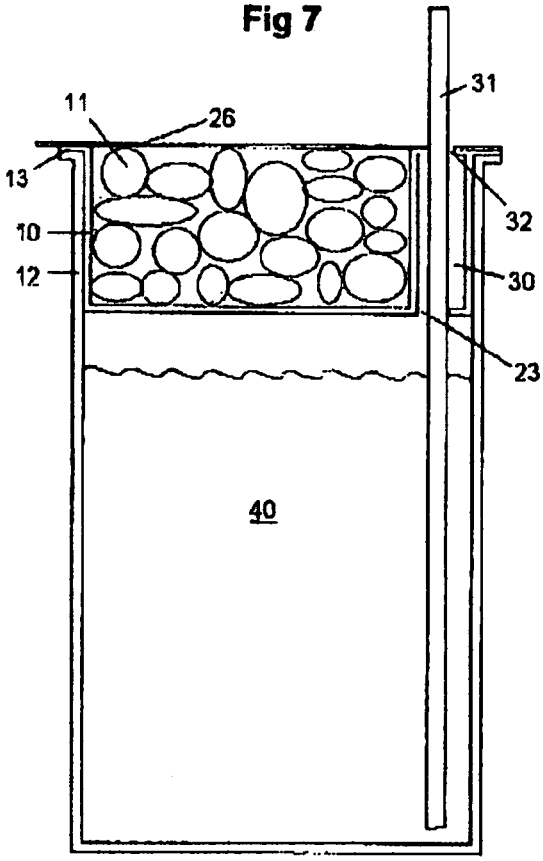
FIG. 5 is a sectional view showing a sealed nut container inserted into a cup filled with beverage.

FIG. 5 is a sectional view of a fifth version in which the container is supported inside the can/cup by a flange 44 extending from the top edge of container 10 is supported on the top edge of cup 12.

In each version, FIGS. 1-5, but shown to best advantage in FIGS. 1, 2, the molded cylinder 14 has a partial lid 24 that extends over part of the open top of the cylinder 14. The partial lid 24 provides better control when pouring nuts from container 12.

In another embodiment of each version, there is no partial lid.

In each version but shown to best advantage in FIGS. 1 and 2, a cover 26, being a thin foil or paper, is adhesively adhered to the top edge of the cylinder 12 and the partial lid 24 and extends over the top opening of the cylinder 14. This feature provides a complete enclosure for the nuts before sale of the nuts occurs.

For access to the nuts 11, the cover 26 is peeled from off the partial lid 24 by grasping a tab 29 attached to this section of the cover and peeling back the cover 26.

Figure 6:
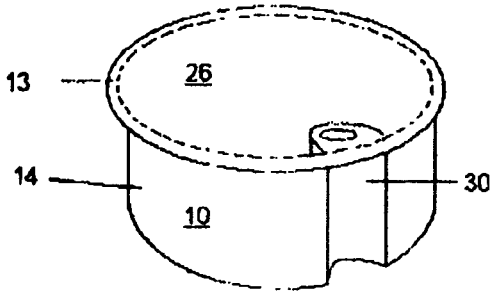
FIG. 6 is a version of FIG. 2 showing a seal adhered to the top edge of the container.

FIG. 6 is a perspective view showing cylinder 14 with flange 13 covered by cover 26. The side of cylinder 14 has a channel 30 extending from top edge to bottom edge of the container 14.

As shown in FIGS. 3C, 4. and 5 when the container 10 of FIG. 6 is mounted on the can/cup 12, the channel 30 provides a guide for positioning drinking straw 31 through hole 32, along channel 30, and through opening 23 in the can 12 down into the beverage 40 stored into the can 12.

Figure 7:
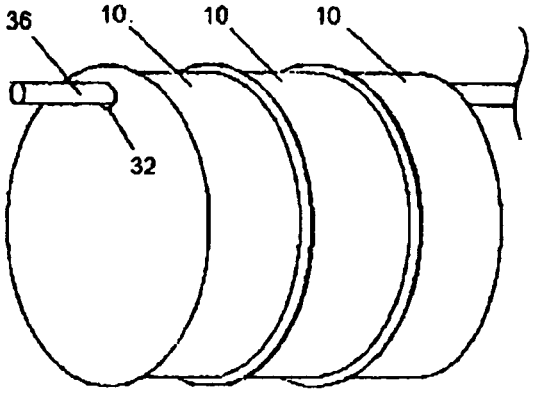
FIG. 7 shows the container of nuts mounted on a peg for retail display.

As shown in FIG. 7, the hole 32 in the tab 29 also provides an opening for displaying a plurality of the containers 10 on a peg 36 for commercial display.

In use, the user selects his container 10 of favorite condiments from a peg 36 and places the container onto the top of a beverage can or cup. Then he peels off the cover 26 and inserts a straw 31 through the channel 30 and hole 23 so that the lower end of the straw extends into the beverage 40 in the can (cup) 12.

The ability to peel off the cover (leaving the partial lid attached to the container) and pour the condiments directly into the mouth is a more dependable method of partaking the condiments than the present method for dispensing condiments (usually peanuts) which is to rip open a cellophane bag and try to empty the nuts directly in the mouth from the bag because a few of the nuts are invariably stuck in the bottom of the bag.

This construction provides several practicalities for the consuming public.

One convenience is that the beverage and/or condiments can be dispensed while holding the container/can in one hand.

Another convenience is that the condiments may be packaged (and sold) separately from the beverage so that the buyer may select any one of a number of condiments.

In the context of this invention, the word, "condiments", is any confection including nuts, mints, chocolates, etc. that are dispensed as "pea-sized" nuggets and as such, are well known to the public.

Variations and modifications of this invention may be contemplated after reading the specification and studying the drawings which are within the scope of the invention.

By following the disclosure of this invention, the nuts and beverage are fully protected from contamination until the consumer is ready to consume the condiments and beverage.

These versions demonstrate the range of scope of the invention.

It is therefore wished to define the scope of the invention by the appended claims.

What is claimed is:

1. A container for holding and dispensing nuggets and together with a standard cup/can holding a beverage, said cup/can having an outside ridge on a top end of said cup/can, said container comprising:

a cylinder having a top end and a bottom side opposite said top end;

a means for engagably mounting said container on said standard cup/can with said bottom side proximal to said beverage and said top end distal from said beverage;

said bottom side and interior of said cylinder defining a region holding said condiments;

a bottom opening in said bottom side;

said bottom opening having a size selected to be smaller than any one of said nuggets and sufficiently large to permit inserting a drinking straw through said opening;

a removable patch adhered on an outer surface of said bottom side over said opening;

a cover adhesively removably attached to a top rim of said cylinder and covering said top end of said cylinder;

a partial top side having an edge joined to said top end of said cylinder and partially covering said top end;

said cover adhesively attached to said partial top side;

said partial top side having an opening aligned to permit positioning a drinking straw through said opening in said partial top side and said opening in said bottom side.

2. The container of claim 1 wherein said means for engageably mounting comprises means for mounting said container on a top end of said cup/can.

3. The container of claim 2 wherein said means for mounting comprises:

a skirt section of said cylinder extending away from said cylinder and said bottom side;

said skirt section having an inside ridge on an end of said skirt section;

said inside ridge dimensioned for telescoping engagement with said outside ridge.

4. The container of claim 1 comprising a channel in a side of said cylinder extending from said top end to said bottom side and aligned with said opening in said partial topside and said opening in said bottom side.

5. The container of claim 2 wherein said means for engageably mounting comprises:

said bottom side having a groove on an outside of said bottom side configured to engage said outside ridge of said cup/can.

6. The container of claim 2 wherein said means for engageably mounting comprises:

a cylindrical sleeve having one end dimensioned for telescoping over said cylinder and another end dimensioned for telescoping over said cup/can.

7. The container of claim 1 wherein said bottom side together with said cylinder is a molded part.

8. The container of claim 5 wherein said partial top side is dimensioned for press fit into said cylinder.

* * * * *